US007628036B1

(12) United States Patent
Chang

(10) Patent No.: US 7,628,036 B1
(45) Date of Patent: Dec. 8, 2009

(54) ADJUSTABLE FINGER RING

(76) Inventor: Hsi Chang, 4F, No. 14-2, Lane 199, Dun-Hwa N. Road, Taipei (TW)

( * ) Notice: Subject to any disclaimer, the term of this patent is extended or adjusted under 35 U.S.C. 154(b) by 0 days.

(21) Appl. No.: 12/140,965

(22) Filed: Jun. 17, 2008

(51) Int. Cl.
*A44C 19/00* (2006.01)
*A44C 9/02* (2006.01)

(52) U.S. Cl. ..... 63/15.5; 63/15; 63/15.7

(58) Field of Classification Search ..... 63/15–15.9, 63/40, 3.1, 21, 23
See application file for complete search history.

(56) References Cited

U.S. PATENT DOCUMENTS 257,023 A * 4/1882 Grange ..... 63/15.5
274,193 A * 3/1883 Henrich ..... 63/15.65
293,831 A * 2/1884 Wickers ..... 2/21
1,434,981 A * 11/1922 Ballard ..... 63/15.5
2,259,059 A * 10/1941 Better ..... 63/4
3,228,208 A * 1/1966 Silverman ..... 63/15.65
5,133,195 A * 7/1992 Appelbaum et al. ..... 63/29.1
5,186,023 A * 2/1993 Goldberg ..... 63/15.5
6,470,708 B1 * 10/2002 Green ..... 63/3.2
6,490,886 B1 * 12/2002 Steinhauer et al. ..... 63/15
6,701,583 B1 * 3/2004 McCullough ..... 24/116 R
6,718,797 B2 * 4/2004 Plumly ..... 63/18

* cited by examiner

*Primary Examiner*—Victor Batson
*Assistant Examiner*—David C Reese
(74) *Attorney, Agent, or Firm*—WPAT, P.C.; Anthony King

(57) ABSTRACT

An adjustable finger ring includes an ornament member and a pair of shank members held by the ornament member. The ornament member includes an E-shaped setting section and a clipping section pivotally connected with the setting section. The setting section has two side-by-side grooves disposed at a bottom side thereof. Each of the grooves is provided with a projected pin. The shank member is substantially C-shaped and provided with a flat top section and a curved bottom section. A width and a thickness of the top section are corresponding to the groove. The top section includes a plurality of adjustment holes disposed along a longitudinal direction thereof. The shank members are received in the grooves and held by the setting section and the clipping section. The size of the ring is adjusted by inserting the projected pin into one of the adjustment holes.

7 Claims, 2 Drawing Sheets

ADJUSTABLE FINGER RING

BACKGROUND OF THE INVENTION

1. Field of the Invention

The present invention relates generally to a finger ring, and more particularly to a finger ring that is adjustable for fingers of various sizes.

2. The Prior Arts

A person afflicted with arthritis, or a person gaining or losing weight would have his or her finger size changed, and could not wear a ring that was previously fit to the finger. The ring has to be taken to a jeweler to resize. The ring is cut, soldered or stretched. However, for some material, such as steel and tungsten, is difficult to resize. On the other aspect, the jeweler needs to carry a large inventory of rings to service customers having various finger sizes, which is not economical. Therefore, an adjustable finger ring to fit fingers of various sizes is disclosed.

A conventional adjustable finger ring includes an upper semi-circular setting section and a lower semi-circular shank section. The setting section has a plurality of longitudinally spaced openings and the shank section has locking ends at both ends thereof. The shank section is made of a resilient material. It is easy to deform the shank section by pressing both ends thereof. When the pressure is relieved, the shank section resumes to its original shape. Thus, a ring wearer can engage the locking ends with the openings at different positions to adjust the ring size. However, because the shank section engages with the setting section at lateral sides of the ring, the ring would have the thickened lateral sides. It makes the wearer uncomfortable.

SUMMARY OF THE INVENTION

A primary objective of the present invention is to provide an adjustable finger ring to fit fingers of various sizes.

Another objective of the present invention is to provide an adjustable finger ring having exchangeable ornament member and shank members. The ornament member can match with various shank members, and the shank members can match with various ornament members.

A still another objective is to provide an adjustable finger ring, which can fit fingers of various sizes without adjusting configuration of the ring. It does not need to adjust the configuration of the finger ring, when the finger size is slightly changed.

A further still objective is to provide an adjustable finger ring, whose ornament member can cooperate with a chain to be worn as a necklace or a bracelet.

In order to achieve the objectives mentioned above, an adjustable finger ring according to the present invention includes an ornament member and a pair of shank members held by the ornament member. The ornament member includes a setting section and a clipping section pivotally connected with the setting section. The setting section has two grooves corresponding to the shank members disposed side by side and at a bottom side thereof. Each of the grooves is provided with a projected pin at a center thereof. The clipping section has two dents corresponding to the projected pins of the grooves. The shank member is provided with a flat top section and a curved bottom section. The top section of the shank includes a plurality of through adjustment holes corresponding to the projected pin of the groove in a longitudinal direction thereof. The shank members are respectively held in the grooves and the projected pins pass through the adjustment holes and are received into the dents. The ring size is adjusted by moving the shank members and fitting the projected pins into various adjustment holes.

Because the shank members and the ornament member are separated members, the adjustable finger ring may have a plurality of pairs of the shank members and a plurality of the ornament members. The shank members and the ornament members are exchangeable to match each other. The shank members may be made of various materials and have various colors, tones, shapes, designs, etc.

Because the shank members do not completely encircle a finger, the shank members are allowed to slightly open outward. Thus, if the finger size only increases a small amount, the adjustable finger ring according to the present invention does not need to make adjustment. The shank members are slightly opened to accommodate the fattened finger.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
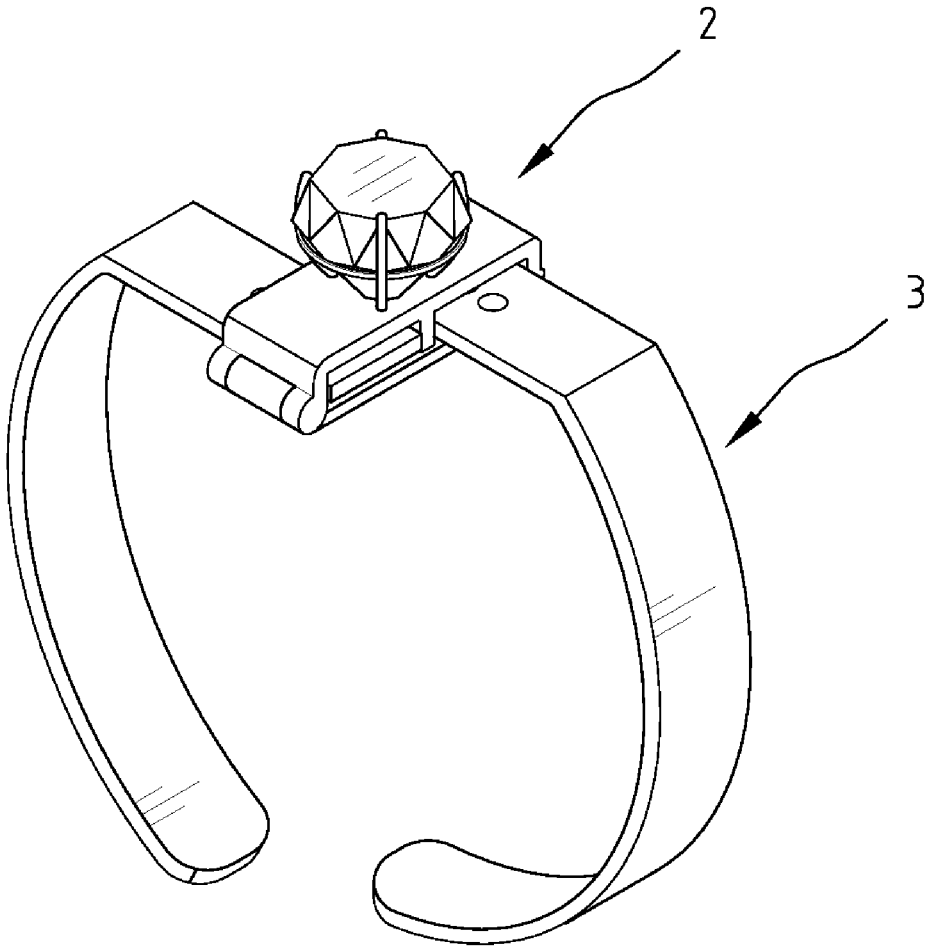
FIG. 1 is a perspective view showing an adjustable finger ring according to the present invention.
Figure 2:
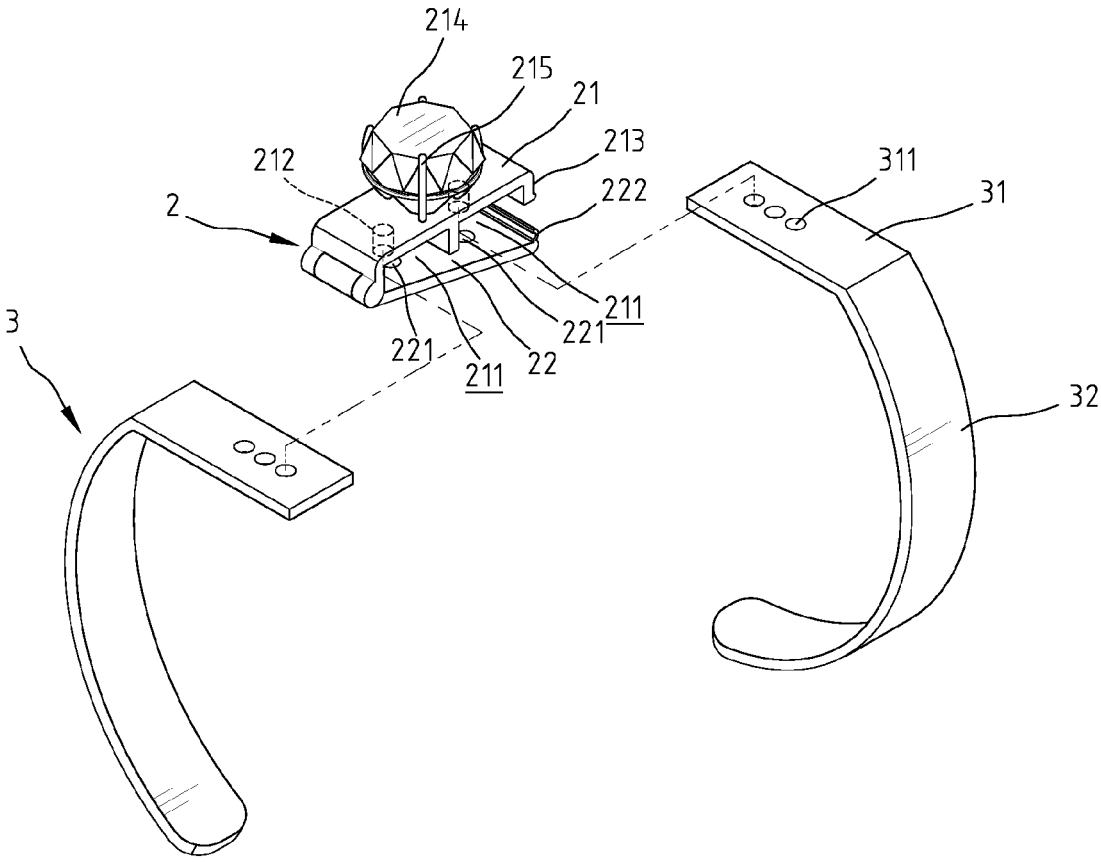
FIG. 2 is an exploded view showing the adjustable finger ring according to the present invention.

Referring to FIGS. 1 and 2, an adjustable finger ring according to the present invention includes an ornament member 2 and a pair of shank members 3 held by the ornament member 2. The ornament member 2 includes an E-shaped setting section 21 and a clipping section 22 pivotally connected with the setting section 21. The E-shaped setting section 21 has two side-by-side grooves 211 corresponding to the shank members 3 disposed at a bottom side thereof. Each of the grooves 211 is provided with a projected pin 212 at a center thereof. A first side of the setting section 21 is pivotally connected with the clipping section 22 and a second side of the setting section 22 that is opposite to the first side is provided with a first engaging portion 213. The setting section 21 may further comprise an ornament piece 214 supported in tines 215 on a top side thereof. The clipping section 22 has two dents 221 corresponding to the projected pins 212 of the grooves 211 at a side facing the setting section 21. A first side of the clipping section 22 is pivotally connected with the setting section 21. A second side of the clipping section 22, which is opposite to the first side, comprises a second engaging portion 222 corresponding to the first engaging portion 213 of the setting section 21. The setting section 21 and the clipping section 22 may be made of gold, silver, stainless steel, titanium, germanium, tungsten carbide, etc. The ornament piece 214 may be a stone, a bead, a gem, a crystal, a pearl, a diamond, an insignia, etc.

The shank member 3 according to the present invention is substantially C-shaped and provided with a flat top section 31 and a curved bottom section 32. A width and a thickness of the top section 31 are corresponding to the groove 211. The top section 31 includes a plurality of adjustment holes 311 disposed along a longitudinal direction thereof. The adjustment holes 311 are through holes and diameters of the adjustment holes 311 are corresponding to the projected pin 212 of the groove 211. The shank member 3 may be made of gold, silver, stainless steel, titanium, germanium, tungsten carbide, etc.

The adjustable finger ring according to the present invention is easy to adjust to accommodate fingers of different sizes. When adjusting the ring size, the setting section 21 and the clipping section 22 are clicked open. The shank members 3 are respectively received in the two grooves 211. The projected pins 212 respectively pass through the adjustment holes 311. The ring size is determined by fitting the projected pins into various adjustment holes 311. When the projected pin 212 is fitted into the adjustment hole 311 that is closest to the bottom section 32, the size of the finger ring is adjusted to the smallest. On the other way, when the projected pin 212 is fitted into the adjustment hole 311 that is farthest away the bottom section 32, the size of the finger ring is adjusted to the largest. After the shank members 3 are adjusted in place, the clipping section 22 is clicked to engage with the setting section 21. The first engaging portion 213 of the setting section 21 engages with the second engaging portion 222 of the clipping section 22, and tips of the projected pins 212 are respectively received in the dents 221. Therefore, the shank members 3 are securely held by the ornament member 2 and the top section 31 are disposed side by side.

Since the adjustable finger ring according to the present invention is assembled from the separated ornament member 2 and the shank members 3, the ornament member 2 and the shank members 3 are interchangeable members. The two shanks members 3 of the adjustable finger ring may be made of different materials and have different shapes, colors, tones, or designs. The adjustable finger ring allows one shank member 3 or both of the shank members 3 to be replaced by others. The finger ring also allows the ornament member 2 to be replaced by the other ornament member 2. The different combinations of the ornament member 2 and the shank members 3 provide variety to the adjustable finger ring. It is especially advantageous for a commemorative ring, such as a class ring, a school ring, a corporate ring and a sport ring. If a commemorative insignia is on the ornament member 2, the adjustable finger ring according to the present invention allows the wearer to personalize the shank members 3 by his or her choice. On the other hand, if a commemorative insignia is on the shank members 3, the adjustable finger ring allows the wearer to choose his or her preferred ornament member 2. The wearer can pick the ornament member 2 having a stone, bead, a jewel, or the like. Moreover, the adjustable finger ring according to the present invention is versatile. The ornament member 2 can cooperate with a chain (not shown). Thus the ornament member 2 and the chain can be a necklace for wearing around a neck or a bracelet for wearing around a wrist or an ankle.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A finger ring that is adjustable to accommodate fingers of different sizes, comprising:

an ornament member, having:

an E-shaped setting section having two side-by-side grooves at a bottom side thereof, each of the grooves provided with a projected pin at a center thereof; and a clipping section pivotally connected with the setting section and provided with two dents corresponding to the projected pins of the grooves at a side facing the setting section; and a pair of shank members respectively received in the grooves, each of the shank members provided with a flat top section and a curved bottom section; a width and a thickness of the top section corresponding to the groove; the top section including a plurality of through adjustment holes disposed along a longitudinal direction thereof; the adjustment holes being corresponding to the projected pin of the groove;

wherein the finger ring is adjusted by inserting the projected pin into one of the adjustment holes; when the setting section engages with the clipping section, the shank members are held therebetween and the projected pins are respectively received in the dents; the top sections of the shank members are disposed side by side.

2. The finger ring according to claim 1, wherein a side of the setting section comprises a first engaging portion and a side of the clipping section comprises a second engaging portion capable of engaging with the first engaging portion, thereby holding the shank members between the setting section and the clipping section.

3. The finger ring according to claim 1, wherein the shank member is made of one of gold, silver, stainless steel, titanium, germanium, and tungsten carbide.

4. The finger ring according to claim 1, wherein the ornament member is made of one of gold, silver, stainless steel, titanium, germanium, and tungsten carbide.

5. The finger ring according to claim 1, wherein the setting section further comprises an ornament piece at a top side thereof.

6. The finger ring according to claim 5, wherein the ornament piece is one of a stone, a bead, a gem, a crystal, a pearl, a diamond, and an insignia.

7. An ornament member, comprising:

an E-shaped setting section having an ornament piece on a top side thereof, two side-by-side grooves at a bottom side thereof, and a first engaging portion at a side thereof, each of the grooves provided with a projected pin at a center thereof; and a clipping section, a first side of the clipping section pivotally connected with the setting section and a second side of the clipping section, which is opposite to the first side, comprising a second engaging portion capable of engaging with the first engaging portion; the clipping section having two dents corresponding to the projected pins of the grooves at a side facing the setting section;

wherein the ornament member is capable of cooperating with a chain for wearing around one of a neck, a wrist and an ankle.

* * * * *